United States Patent [19]

Padget

[11] Patent Number: 4,740,179

[45] Date of Patent: Apr. 26, 1988

[54] SELF-SPREADING BATTERY TERMINAL CONNECTORS

[76] Inventor: Clifton A. Padget, 1203½ Colorado Dr., Dodge City, Kans. 67801

[21] Appl. No.: 930,884

[22] Filed: Nov. 17, 1986

[51] Int. Cl.[4] ..... H01R 4/38

[52] U.S. Cl. ..... 439/765

[58] Field of Search ..... 339/231, 232, 263 B; 439/765, 766, 767, 768, 771

[56] References Cited

U.S. PATENT DOCUMENTS 3,505,636 4/1970 McDowell ..... 339/231

*Primary Examiner*—Gil Weidenfeld
*Assistant Examiner*—Paula A. Austin
*Attorney, Agent, or Firm*—Gilden & Israel

[57] ABSTRACT

Several embodiments of self-spreading battery terminal connectors utilize restricted movement bolts. In each embodiment, the battery terminal connector bolt is freely rotatable without experiencing threaded axial movement in one side of the connector, with the opposite connector then being movable along the bolt to open or close the connector around a battery terminal.

5 Claims, 2 Drawing Sheets

SELF-SPREADING BATTERY TERMINAL CONNECTORS

BACKGROUND OF THE INVENTION

1. Field of the Invention

The present invention relates to battery terminal connectors, and more particularly pertains to several embodiments of self-spreading terminal connectors which operably open or close around a battery terminal in response to a rotatable movement of the associated bolt.

2. Description of the Prior Art

It is well known in the prior art that present day battery terminal connectors typically tend to lock or freeze to an associated battery post. In this respect, when a connector is placed over a battery post and the associated bolt and nut tightened to draw the clamping member tightly around the post, the clamping member metal is deformed into the bolt body threads which effectively causes a binding action between the clamp and bolt. This binding action prevents the clamping member from being subsequently easily removed without the use of special tools and efforts.

As such, it can be appreciated that there exists a continuing need for new types of battery post connectors which would easily open and close around a battery post in response to a concurrent rotatable movement of the connector bolt. In this regard, the present invention substantially fulfills this need.

SUMMARY OF THE INVENTION

In view of the foregoing disadvantages inherent in the known types of battery terminal connector assemblies now present in the prior art, the present invention provides several embodiments of an improved battery terminal connector wherein the same can be opened or closed around a battery post simply through the rotatable movement of the associated through-extending connector bolt. As such, the general purpose of the present invention, which will be described subsequently in greater detail, is to provide new and improved battery terminal connectors which have all the advantages of the prior art battery terminal connectors and none of the disadvantages.

To attain this, a first embodiment of the present invention comprises a bolt extending through the two legs of a battery terminal connector, with the bolt being fixedly secured in one leg of the connector through the use of a pin extending through the leg. In this regard, the bolt is provided with a circumferentially-extending concave groove into which the pin extends, thereby to prevent axial movement of the bolt through the leg irrespective of a rotatable movement of the bolt. The portion of the bolt which extends into the second leg passes through a nut which threadably moves along the bolt while being captured in position within the second leg. As such, a rotatable threaded movement of the nut results in a concurrent movement of the second leg relative to the first leg. Thus the bolt can be rotated to vary the spacing between the first and second legs, so as to open or close the connector around an associated battery post.

A second embodiment of the invention utilizes the same bolt structure captured in the first leg of a connector through the use of a through-extending pin, with the second leg of the connector being threaded so as to threadably move along the bolt in response to a rotation thereof. The second leg of the connector in this second embodiment is substantially thickened so as to provide the necessary strength required for relative movement between the two legs.

A third embodiment of the invention addresses that situation where the connector is made of a flexibly movable but relatively strong material, such as iron, whereby the second leg of the connector is internally threaded and is of a thin construction. This third embodiment of the invention is in all other respects identical to the second embodiment of the invention.

A fourth embodiment of the invention utilizes a bolt extending through the two legs of a connector, with the second leg being threadably movable along the bolt in a similar manner similar to the other embodiments of the invention. However, the through-extending pin is not present in the first leg of this embodiment of the invention, but rather a retainer ring is snap fitted around a groove formed in the bolt and positioned in the space between the two legs. As such, the bolt is allowed to rotatably move within the first leg without experiencing any axial movement relative thereto, while the second leg then travels along the bolt.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved battery terminal connectors which have all the advantages of the prior art battery terminal connectors and none of the disadvantages.

It is another object of the present invention to provide new and improved battery terminal connectors which may be easily and efficiently manufactured and marketed.

It is a further object of the present invention to provide new and improved battery terminal connectors which are of a durable and reliable construction.

An even further object of the present invention is to provide new and improved battery terminal connectors which are susceptible of a low cost of manufacture with regard to both materials and labor, and which accordingly is then susceptible of low prices of sale to the consuming public, thereby making such battery terminal connectors economically available to the buying public.

Still yet another object of the present invention is to provide new and improved battery terminal connectors which provide in the apparatuses and methods of the prior art some of the advantages thereof, while simultaneously overcoming some of the disadvantages normally associated therewith.

Still another object of the present invention is to provide new and improved battery terminal connectors which permit an easy connection thereof to associated battery posts.

Yet another object of the present invention is to provide new and improved battery terminal connectors which only require associated bolt rotation to effect their easy opening or closing around a battery post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
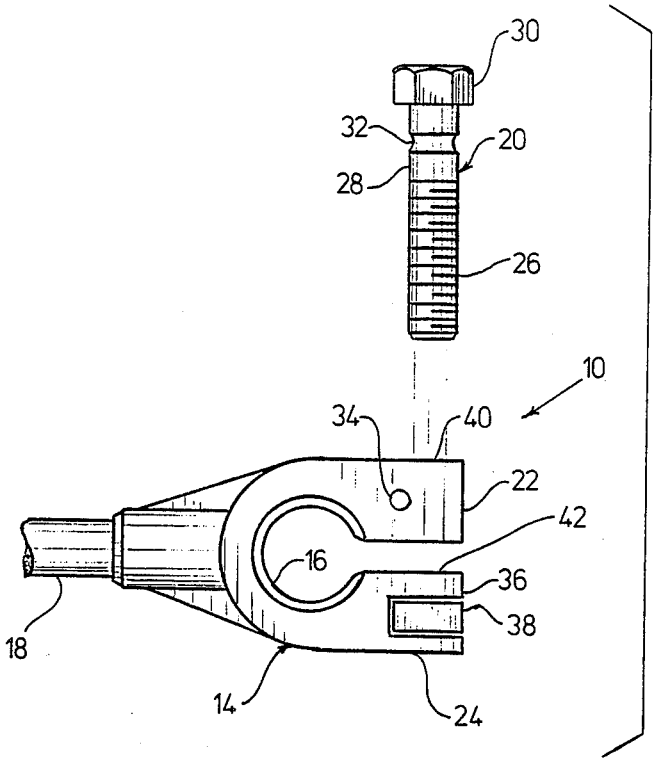
FIG. 1 of the drawings is a top plan view of a first embodiment of the battery terminal connector comprising the present invention.

With reference now to the drawings, and in particular to FIG. 1 thereof, a first embodiment of a new and improved self-spreading battery terminal connector embodying the principles and concepts of the present invention and generally designated by the reference numeral 10 will be described.

More specifically, it will be noted that the self-spreading battery terminal connector 10 essentially comprises a deformable connector 14 having a substantially circular opening 16 which is positionable over a conventional battery post. The connector 14 is, of course, electrically conductive and is attached to an electrical cable 18 which is also of a conventional design. The connector 14 further includes a through-extending bolt 20 which is positionable through first and second legs 22, 24 that form a integral part of the connector 14. As illustrated, the bolt 20 includes a threaded portion 26 and an unthreaded portion 28 proximate the bolt head 30. Additionally, a circumferentially-extending concave groove 32 is machined into the bolt.

While the battery post connector 14 is basically of a conventional design, certain improvements have been made thereto which comprises some of the novel aspects of the present invention. For example, the first leg 22 of the connector 14 includes a through-extending aperture 34 designed to receive a removably positioned pin therein. Similarly, the second leg 24 includes a cut-out portion 36 into which is captured a conventional threaded nut 38. The opening 36 holds the nut 38 securely in position and prevents its relative rotation.

With respect to the manner of usage and operation of this first embodiment 10 of the invention, it can be seen that the bolt 20 may be positioned through a conventional through-extending aperture 40 formed in the first leg 22 and further extends through a second through-extending aperture 42 formed in the second leg 24. In this regard, the bolt 20 is threadably positionable through the nut 38 when it is directed through the apertures 40, 42, so as to completely extend through the legs 22, 24. An unillustrated pin is then inserted through the aperture 34 with the external curved surface of the pin then being positioned within the groove 32 formed on the bolt 20. A counter-clockwise rotation of the bolt results in the nut 38 travelling downwardly along its axial length, thus to force the leg 24 away from the leg 22. This results in a concurrent enlargening of the opening 16 so as to allow its positioning over or removal from an unillustrated battery post. This relative movement between the legs 22, 24 is made possible through the fixed positioning of the bolt 20 in the leg 22 by the pin inserted through the aperture 34, i.e., the pin prevents axial movement of the bolt within the leg 22. When it is desired to tighten the connector 14 around a battery post, a clockwise rotation of the bolt 20 will pull the nut 38 upwardly along an axial length thereof, thus to concurrently move the leg 24 towards the leg 22 and reduce the size of the opening 16 in a now apparent manner.

Figure 2:
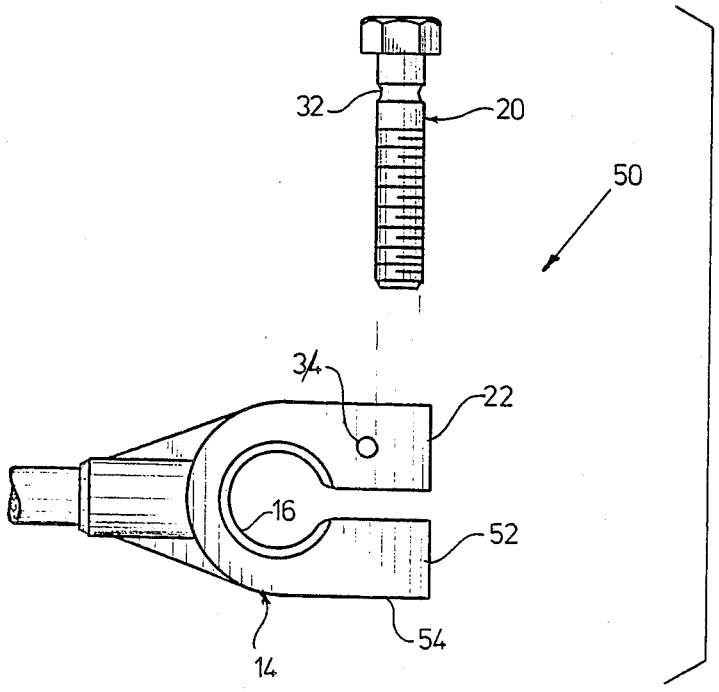
FIG. 2 is a top plan view of a second embodiment of the invention.

FIG. 2 of the drawings illustrates a modified embodiment of the invention generally designated by the reference numeral 50. As illustrated, the second embodiment 50 of the invention includes the aforementioned connector 14 and its associated through-extending connector bolt 20. Additionally, the connector 14 includes a leg 22 having a through-extending aperture 34 for receiving an unillustrated pin, with such pin conformingly mating with a groove 32 formed on the bolt 20. As such, the bolt 20 is restricted against axial movement during a rotation thereof within the leg 22 as with the first embodiment 10 of the invention.

With further reference to FIG. 2 of the drawings, it will be seen that the second embodiment 50 includes a modified second leg structure which is generally designated by the reference number 52. More specifically, the leg 52 dispenses with the captured nut 38 as shown in the first embodiment 10 of the invention, but rather relies upon a thickened portion having a threaded through-extending aperture 54. While the bolt 20 was only threadably engageable with the nut 38 in the first embodiment 10 of the invention, in the second embodiment 50, the bolt is directly threadably engagable with the leg 52. Since most connectors 14 are formed of an electrically conductive soft material, such as lead or the like, it is necessary that the second leg 52 be substantially thickened so as to provide the necessary strength for repeated threaded movement along the bolt 20.

The manner of usage and operation of the second embodiment 50 of the invention should be apparent from the above description. However, a brief summary thereof will be provided. More specifically, it will be observed that the counter-clockwise rotation of the bolt 20 will effect a threaded movement of the leg 52 away from the leg 22 inasmuch as the bolt is prevented against axial movement relative to the first leg. This of course results in an enlargening of the opening 16 to thus permit the positioning of the connector 14 over or its removal from an associated battery post. A clockwise rotation of the bolt 20 then results in relative movement between the legs 22, 54 towards one another to thus effect a tightening of the connector 14 over a battery post.

Figure 3:
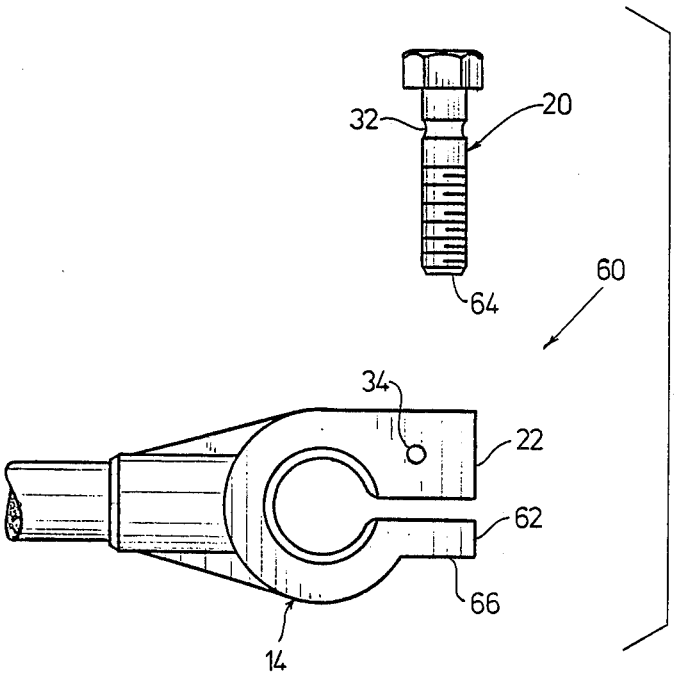
FIG. 3 is a top plan view of a third embodiment of the invention.

FIG. 3 of the drawings illustrates a third embodiment of the invention which is generally designated by the reference numeral 60. The third embodiment 60 includes the same connector 14 having a first leg 22 with a through-extending aperture 34 and through which is positionable a connector bolt 20. In this third embodiment 60, the bolt 20 is still provided with a groove 32 which conformingly receives a pin extending through the aperture 34, thereby to prevent axial movement of the bolt relative to the first leg 22. The modification of this third embodiment 60 of the invention includes the forming of the connector 14 from a much stronger and less deformable electrically conductive material, such as iron or the like. Accordingly, a second leg 62 of the connector 14 must be by necessity of a much thinner construction to afford the desired relative movement between the first and second legs 22, 62, respectively. Additionally, this construction then allows for an end 64 of the bolt 20 to extend outwardly from the second leg 62, whereby an unillustrated nut may be threadably positioned over the bolt to provide additional securement thereof to the connector 14. More particularly, the unillustrated nut may be threadably moved along the bolt 20 into an abutting relationship with a face 66 of the second leg 62, thereby to effect the desired locked positioning of the bolt 20 in the connector 14.

The manner of usage and operation of this third embodiment 60 of the invention should also be apparent from the above description. In this regard, such usage is identical to the described usage of the second embodiment 50 of the invention, with the exception that the unillustrated locking nut may also be utilized in a now apparent manner.

Figure 4:
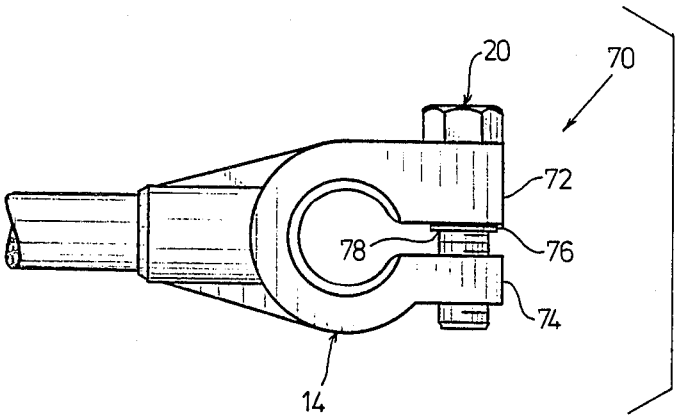
FIG. 4 is a top plan view of a fourth and final embodiment of the invention.

FIG. 4 of the drawings illustrates a fourth and final embodiment of the invention which is generally designated by the reference numeral 70. This final embodiment 70 includes the aforementioned connector 14 and its through-positionable bolt 20. The embodiment 70 includes a first leg 72 and a second leg 74, and the afore-discussed through-extending aperture 34 has been dispensed with. In this last embodiment 70, a conventional snap ring 76 is positionable within a circumferentially-extending concave groove 78 formed on an intermediate portion of the bolt 20. The snap ring 76 is of a conventional circular construction having an opening on one side thereof, whereby a spring biased forced positioning of the ring into the groove 78 can be accomplished. Once the ring 76 is positioned in the groove 78, relative axial movement of the bolt 20 within the leg 72 is prevented. By the same token, the leg 74 may then include a threaded through-extending aperture such as illustrated with respect to the second and third embodiments 50, 60, respectively. If desired, a nut 38 could also be captured within the second leg 72 in the manner of the first embodiment 10 of the invention.

The manner of operation of this final embodiment 70 of the invention is substantially similar to that of the above-discussed embodiments 10, 50, 60. As can be appreciated, a counter-clockwise rotation of the bolt 20 will effect a spreading of the legs 72, 74 apart, while a clockwise rotation of the bolt will pull the legs together to thus clamp the connector 14 around a battery post.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A self-spreading battery post connector comprising:

a. connector means having a central opening positionable over said battery post, said connector means being partially formed from first and second legs flexibly movable relative to one another to thus vary a clamping size of said central opening over said battery post;

b. bolt means extending through said first and second legs, said bolt means being rotatable to permit relative spaced-apart movement between said first and second legs, thus to vary said clamping size of said central opening; and, c. pin means for preventing axial movement of said bolt means relative to said first leg during a rotatable movement of said bolt means, said pin means extending through a through-extending aperture formed in said first leg.

2. The self-spreading battery post connector of claim 1, wherein said pin means further conformingly engages a circumferentially-extending groove formed in said bolt means.

3. The self-spreading battery post connector of claim 2, wherein said bolt means is threadably engageable with said second leg.

4. The self-spreading battery post connector of claim 3, wherein said bolt means engages a nut captured within a slot formed in said second leg.

5. The self-spreading battery post connector of claim 4, wherein said nut is prevented against rotatable movement during a rotation of said bolt means.

* * * * *